US006789279B2

(12) United States Patent
Yarid

(10) Patent No.: US 6,789,279 B2
(45) Date of Patent: Sep. 14, 2004

(54) SHOWER CURTAIN CLOSURE DEVICE

(76) Inventor: Amel David Yarid, 333 Church St., Lewisburg, WV (US) 24901

( * ) Notice: Subject to any disclaimer, the term of this patent is extended or adjusted under 35 U.S.C. 154(b) by 54 days.

(21) Appl. No.: 10/637,076

(22) Filed: Aug. 8, 2003

(65) Prior Publication Data

US 2004/0034921 A1 Feb. 26, 2004

Related U.S. Application Data

(63) Continuation-in-part of application No. 10/227,348, filed on Aug. 26, 2002, now abandoned.

(51) Int. Cl.[7] ..... A47K 3/38
(52) U.S. Cl. ..... 4/609; 4/608; 4/558
(58) Field of Search ..... 4/609, 608, 607, 4/605, 610, 558, 557; 160/349.1

(56) References Cited

U.S. PATENT DOCUMENTS

| | | | | | |
|---|---|---|---|---|---|
| 2,049,061 | A | * | 7/1936 | Hoegger, Sr. | 160/327 |
| 2,923,013 | A | * | 2/1960 | Morris | 4/610 |
| 4,098,318 | A | * | 7/1978 | Ruegsegger | 160/349.2 |
| 5,216,766 | A | * | 6/1993 | Lang | 4/609 |
| 6,510,566 | B2 | * | 1/2003 | Bryce | 4/609 |

* cited by examiner

*Primary Examiner*—Gregory L. Huson
*Assistant Examiner*—Khoa Huynh

(57) ABSTRACT

A long rod that has a hanging hook at one end is attached to the leading vertical edge of the inner shower curtain or shower curtain liner and is hung on a hook located at shower curtain rod height inside the shower or bath/shower enclosure or attached to a wall mounted upper rod clip. Snugging the bottom of the device to a horizontally aligned hook or attached to a clip near the bottom of its length completes the splash water seal.

2 Claims, 8 Drawing Sheets

SHOWER CURTAIN CLOSURE DEVICE

This application is a continuation-in-part of 10/227,348 filed Aug. 26, 2002, now abandoned.

DESCRIPTION OF RELATED ART

Prior art abounds with various attempts for a solution to this problem, as reflected in the following U.S. patents:

a.) U.S. Pat. No. 2,232,194 to Zogby, February 1941 has suction cup held, horizontal retaining rod placed inside the tub to hold bottom of shower curtain.

b.) U.S. Pat. No. 2,303,502 to Rous, December 1942 has vertical bracket to grab the end of shower curtain.

c.) U.S. Pat. No. 2,608,250 to Meyer, August 1952 has multiple suction cups to hold end of shower curtain.

d.) U.S. Pat. No. 2,642,248 to Semon, June 1953 is a multiple suction cup device to hold shower curtain.

e.) U.S. Pat. No. 2,712,354 to Margolies, July 1955 is a rod attached to the shower curtain end.

f.) U.S. Pat. No. 3,639,919 to White, February 1972 is a flexible gripping device to hold end of shower curtain.

g.) U.S. Pat. No. 4,070,735 to Canaday, January 1978 is a suction cup fastening device to hold shower curtain.

h.) U.S. Pat. No. 4,279,396 to Bendock, July 1981 is a suction cup fastening device to hold shower curtain.

i.) U.S. Pat. No. 4,723,326 to Tarlow et al, February 1988 is for weights attached to the bottom of shower curtain.

j.) U.S. Pat. No. 5,023,964 to Unsworth, June 1991 is for a suction cup device attached to the end of the shower curtain.

k.) U.S. Pat. No. 5,070,551 to Harrison et al, December 1991 is for a plurality of wall fasteners positioned along the vertical slope of the shower curtain.

l.) U.S. Pat. No. 5,421,393 to Wolfe, June 1995 for horizontal device at bottom of shower curtain to prevent curling.

m.) U.S. Pat. No. 5,561,870 to Hertel, October 1996 for a curved adapter extension to be placed on the shower curtain rod.

n.) U.S. Pat. No. 6,067,672 to Klotz, May 2000 to a transverse vertical bracket to hold end of shower curtain.

o.) U.S. Pat. No. 6,094,755 to Matta, August 2000 for a base strip and a magnetized strip affixed to shower curtain and wall to hold curtain in place.

p.) U.S. Pat. No. 6,148,452 to Kirsopp, November 2000 for a system of vertical U shaped brackets at both ends of the shower curtain rod with curtain adapters to create an enclosed stall.

q.) U.S. Pat. No. 6,154,894 to Alexander et al, December 2000 for a system of L shaped brackets at both ends of the shower curtain rod with curtain adapters to allow attachment and detachment to enclose or open the stall.

r.) U.S. Pat. No. 6,499,225 to Colvin, March 2001 for a system of attaching the shower curtain to the inside wall with Velcro.

s.) U.S. Pat. No. 6,292,957 to Thompson, September 2001 for a shower curtain retainer assembly using disks and magnets along bottom of shower curtain and inside of tub.

t.) U.S. Pat. No. 6,317,904 to Samelson, November 2001 for double suction cup fasteners heat sealed to the shower curtain liner.

BACKGROUND OF THE INVENTION

This invention relates to shower curtains or shower curtain liners allowing for a seal to prevent water splash-out from the enclosure.

BRIEF SUMMARY OF THE INVENTION

After initial installation of the inside wall mounting hook, the inside lower sealing hook, the removal of the end shower curtain to shower curtain rod holding ring and the attachment of the shower curtain closure device to the leading vertical edge of the shower curtain and is hung on the shower curtain rod in the non-shower use mode. In this configuration, it can be used as a push-to-open or pull-to-close handle for the shower curtain. In the seal mode, the curtain is closed and the device is lifted off of the shower curtain rod and is hung on the inside wall mounting hook and snugged in the inside lower sealing hook for an effective and complete seal of water splash-out.

REFERENCE NUMERALS IN THE DRAWING

Figure 1:
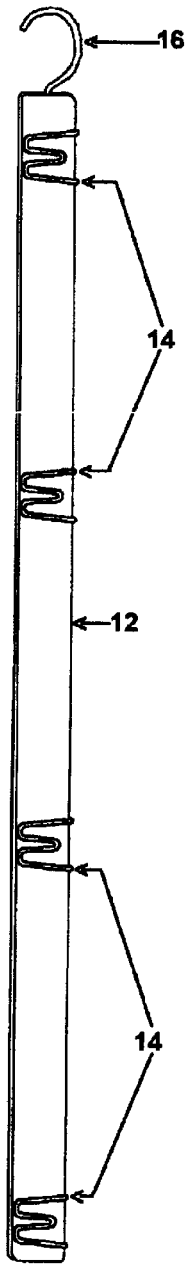
FIG. 1 is a view of a rectangular version of the shower curtain closure device with attached shower curtain holding clips.

12. shower curtain closure device
14. shower curtain holding clip(s)
16. shower curtain closure device hanging hook
17. inside wall mounting clip(s)
18. inside wall mounting hook
19. lower inside wall sealing hook
20. shower curtain
22. shower curtain rod
24. shower curtain holding ring(s) or hook(s)

DETAILED DESCRIPTION OF THE INVENTION

With minimal permanent impact on design of shower stalls and bath/shower enclosures, this invention provides a very easy and broadly applicable way to solve the accidental water leakage problems from showers.

Figure 2:
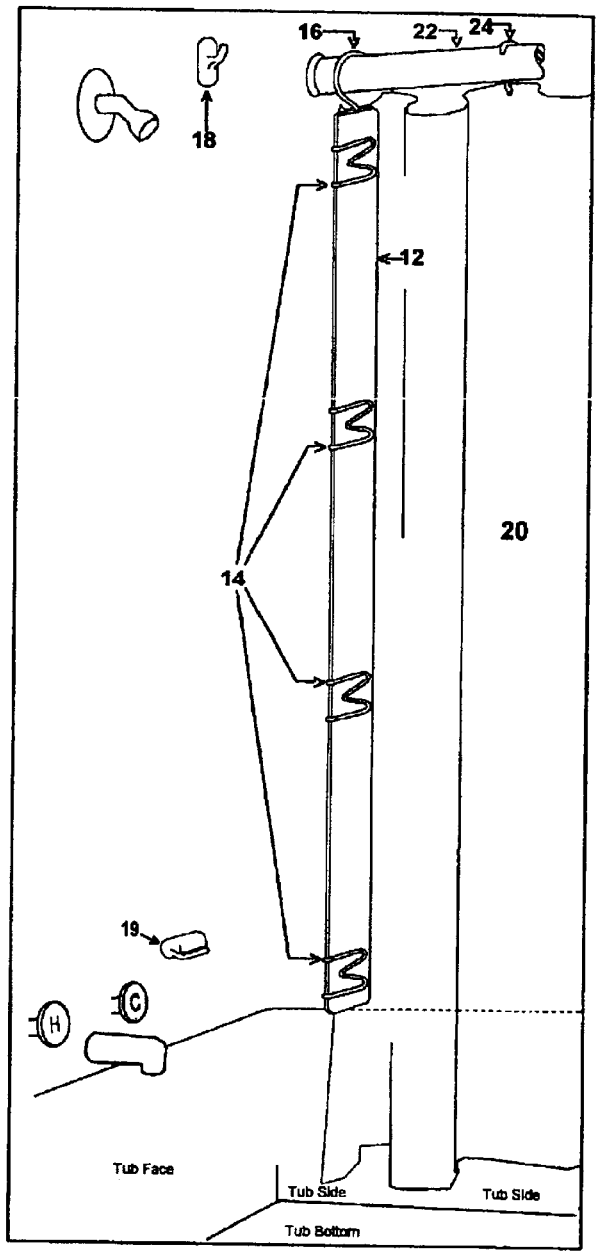
FIG. 2 is an inside enclosure view with the inside wall mounting hook and the lower inside sealing hook in place and the shower curtain closure device hanging on the shower curtain rod and attached to the shower curtain.
Figure 3:
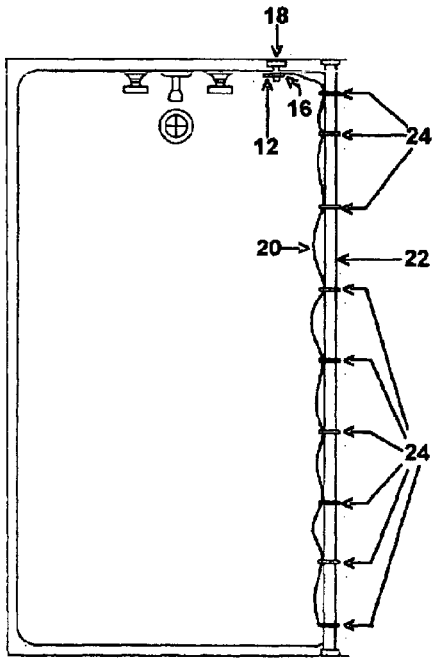
FIG. 3 is an overhead view of the shower curtain closure device in the seal mode.
Figure 6:
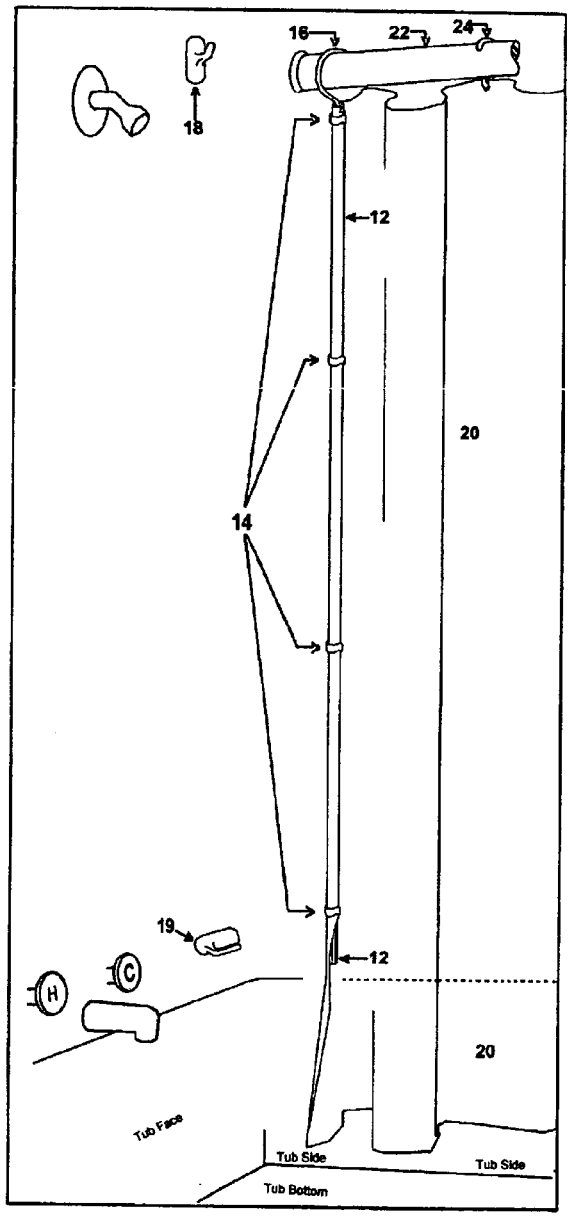
FIG. 6 is the same description as FIG. 2, but using the rod shaped shower curtain closure device.
Figure 8:
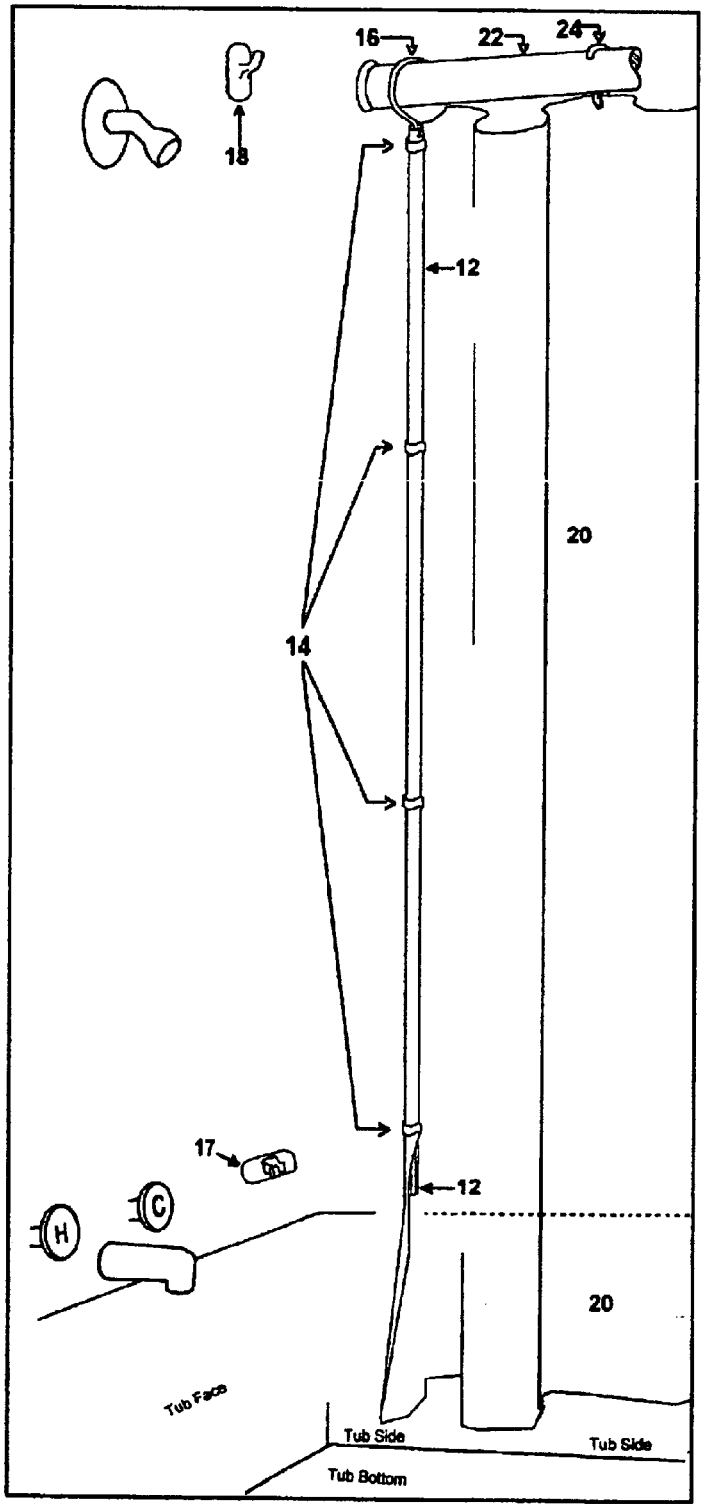
FIG. 8 is the same description as FIG. 6, but using a wall clip in place of the lower sealing hook.
Figure 10:
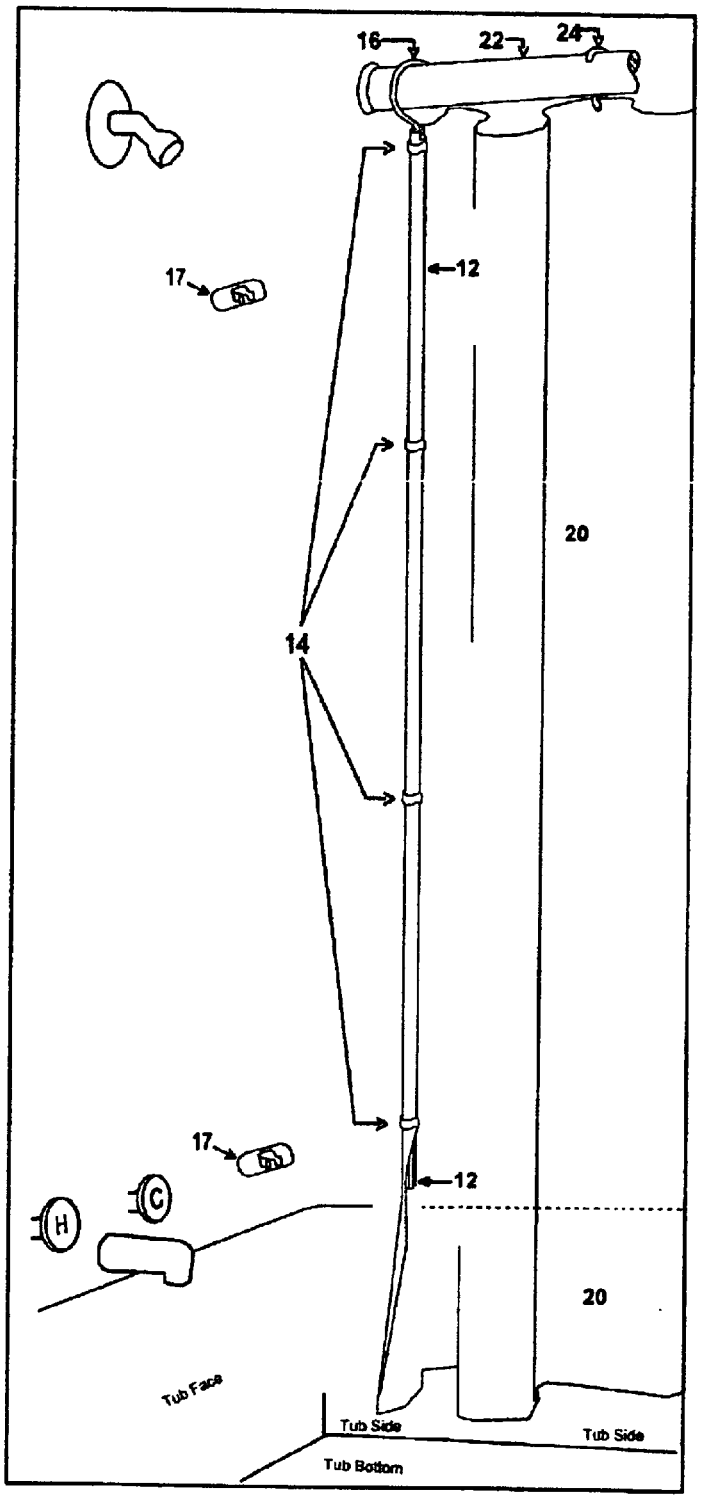
FIG. 10 is the same description as FIG. 8, but using a wall clip in place of the wall mounting hook.

The installation consists of permanently attaching the inside wall mounting hook 18 approximately four inches from and at the vertical plane of the shower curtain rod 22 (see FIGS. 2, 6 and 8) or an inside mounting clip 17 approximately six inches lower than the vertical plane of the shower curtain rod 22 (see FIG. 10). Also mounting the horizontal lower sealing hook 19 (see FIGS. 2 and 6) or lower mounting clip 17 (see FIG. 8) approximately fifty inches below the wall mounting hook 18 or approximately 44 inches below the upper mounting clip 17 (see FIG. 10). The end shower curtain ring (or hook) 24 from the inside shower curtain or shower curtain liner 20 to the shower curtain rod 22 is removed. The vertical edge of the shower curtain or shower curtain liner 20 is attached to the shower curtain closure device 12 by insertion into clips 14 on the rectangular version or by wrapping the curtain's vertical edge around the rod version and securing it with clips 14.

Figure 4:
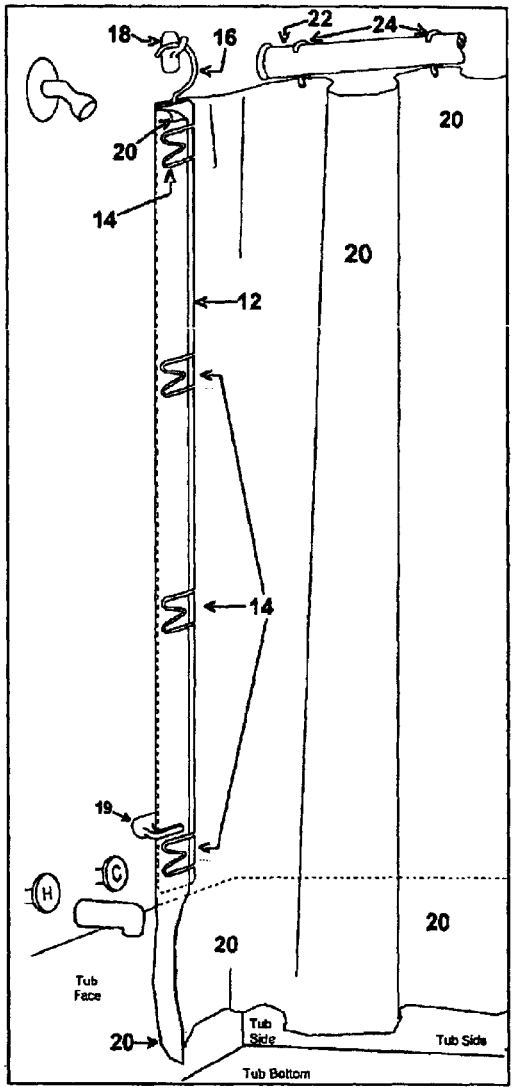
FIG. 4 is an inside enclosure view in the seal mode.
Figure 5:
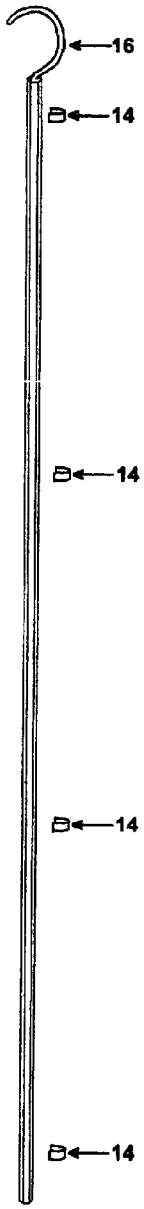
FIG. 5 is a view of a rod shaped version of the shower curtain closure device showing the detached shower curtain holding clips.
Figure 7:
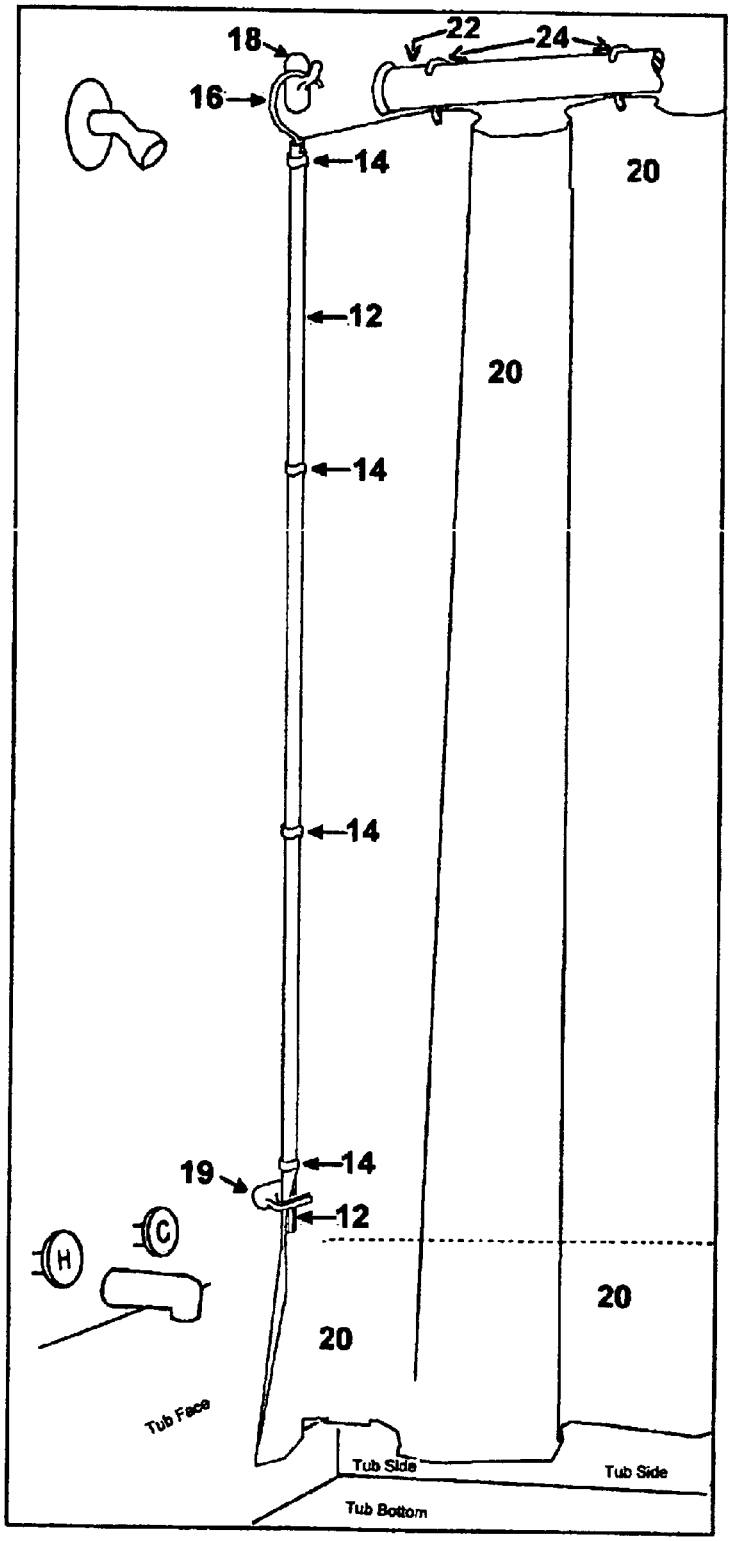
FIG. 7 is the same description as FIG. 4, but using the rod shaped shower curtain closure device.
Figure 9:
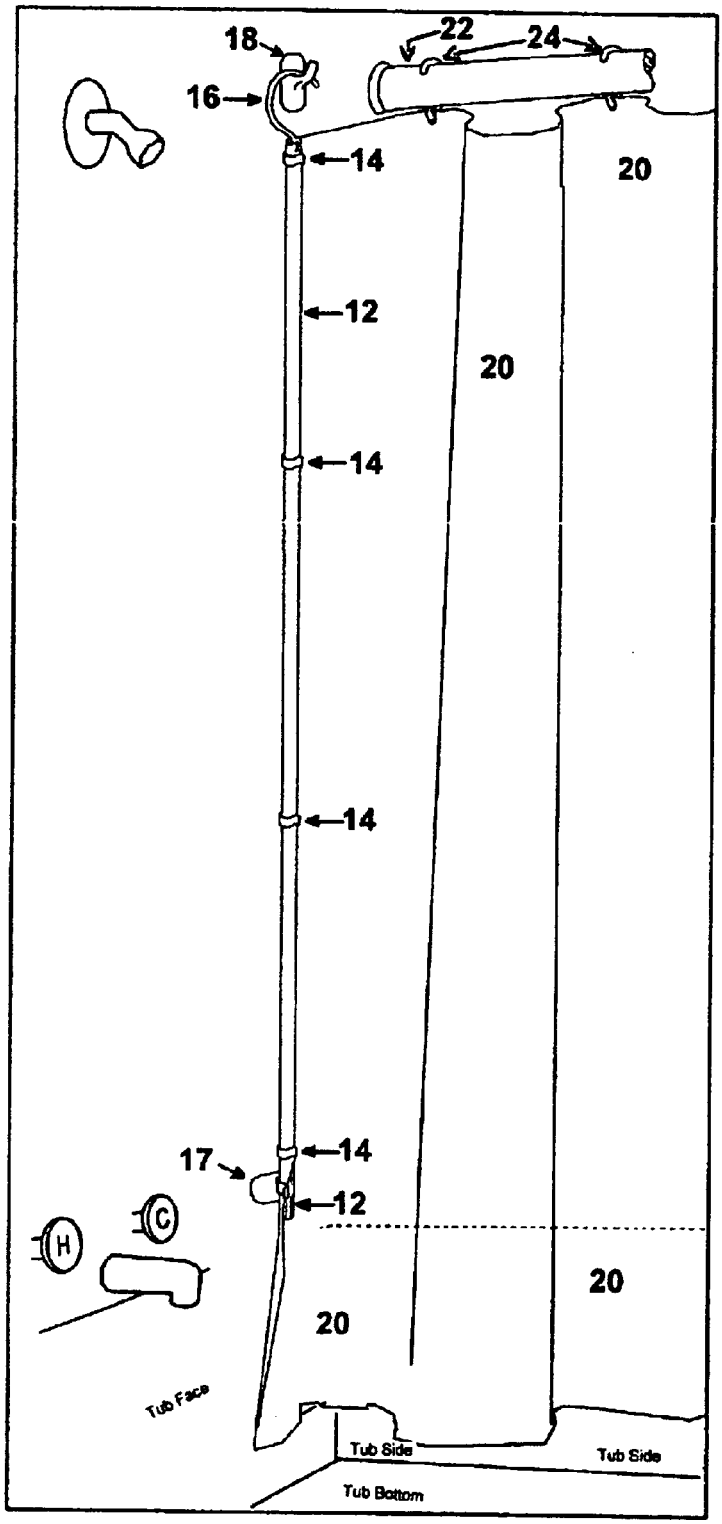
FIG. 9 is the same description as FIG. 7, but using a wall clip in place of the lower sealing hook.
Figure 11:
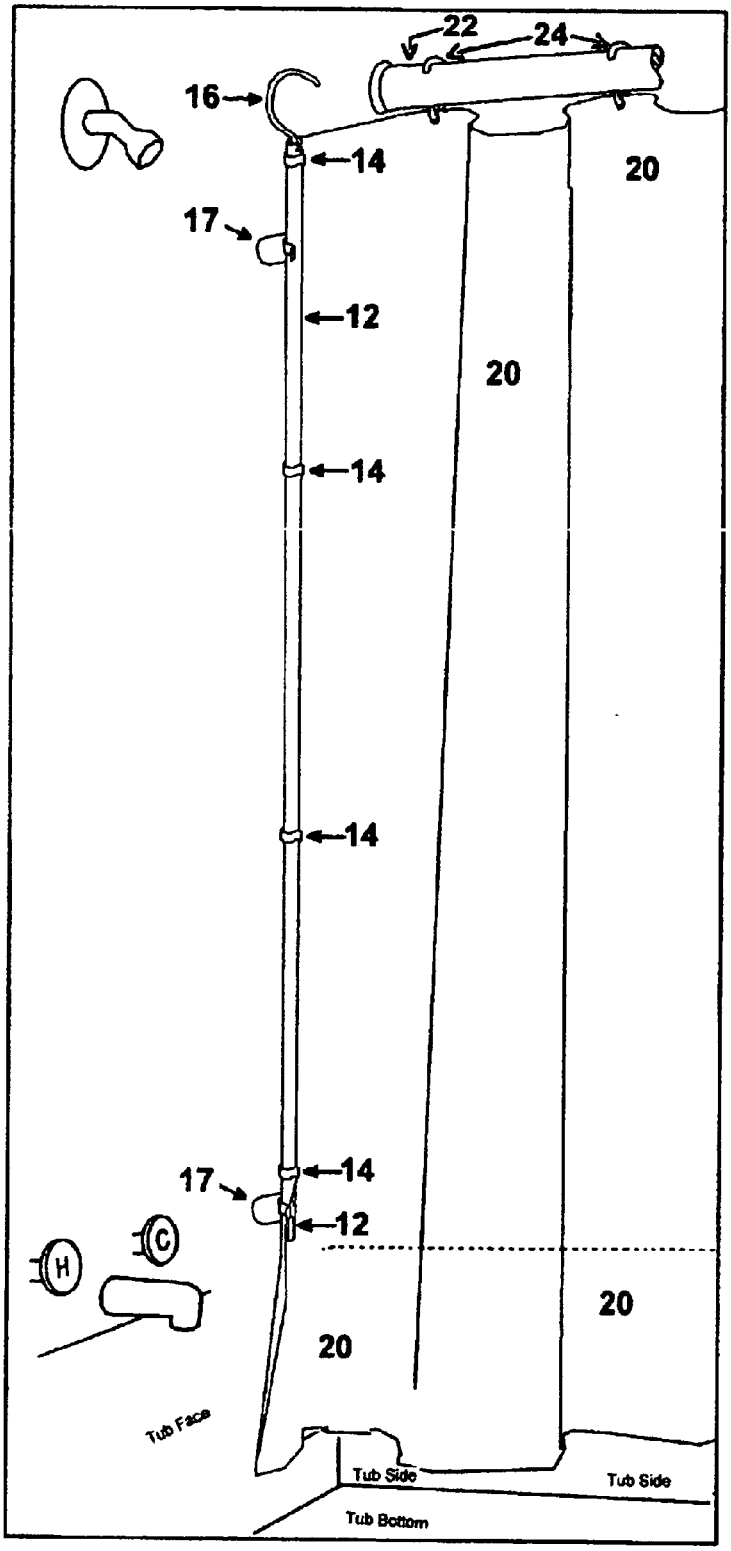
FIG. 11 is the same description as FIG. 9, but using a wall clip in place of the wall mounting hook.

To effect it's use, the shower curtain closure device 12 with attached shower curtain 20 is lifted from the shower curtain rod 22 and hung on the inside wall mounting hook 18 (see FIGS. 4, 7 and 9) or attached to upper mounting clip 17 (see FIG. 11), then the lower part of the shower curtain closure device 12 is snugged into the horizontal lower sealing hook 19 (see FIGS. 4 and 7), or attached to lower clip 17 (see FIGS. 9 and 11) to complete the water splash-out seal. To open, the shower curtain closure device 12 is disengaged from the inner enclosure attaching devices and rehung on the shower curtain rod 22. In this configuration, shower curtain closure device 12 can be used as a push-to-open or pull-to-close handle for the shower curtain 20.

VARIATIONS IN ASSEMBLY OF THE INVENTION

The curtain may be affixed to the shower curtain closure device with built in clips or by making the major or entire length of the device a clamp or it may be threaded into and held in place by slits along its edge.

Instead of being externally attached, the shower curtain closure device may be inserted into or built into a sleeve in the shower curtain's or liner's vertical edge.

In lieu of or in conjunction with the methods previously described to attach to the vertical wall of the shower or shower/tub enclosure, the shower curtain closure device, along with it's connected curtain, can be secured to the upper and lower area of the inside wall of the shower or shower/tub enclosure by using any combination of hook, clip, snap, velcro, suction cup or magnetic attaching devices to secure the seal.

An added advantage of the installation of this device is the reduction of or complete elimination of turbulent air generated shower curtain flapping, often common to loose shower curtains and poor end seals.

What is claimed is:

1. A shower curtain closure device, in combination, with a shower curtain or a shower curtain liner, a shower curtain rod, a plurality of curtain rings the shower curtain or shower curtain liner having a vertical edge, with the end ring removed, the curtain closure device comprising, a rod attaching to the vertical edge of the shower curtain or shower curtain liner, a hanging hook having one end attaching to the rod and an opposite end hanging on the shower curtain rod, a vertically-mounted upper inside wall hook a horizontally-mounted lower inside sealing hook, wherein the hanging hook allows the shower curtain or shower curtain liner to be lifted from the shower curtain rod, moved inwardly a predetermined distance and hung on vertically-mounted upper inside wall hook while the lower part of the shower curtain closure device is snugged to the horizontally-mounted lower inside sealing hook to complete the water splash-out seal.

2. A shower curtain closure device, in combination, with a shower curtain or a shower curtain liner, a shower curtain rod, a plurality of curtain rings the shower curtain or shower curtain liner having a vertical edge, with the end ring removed, the curtain closure device comprising, a rod attaching to the vertical edge of the shower curtain or shower curtain liner the rod is held in contact with the vertical edge by a plurality of retaining clips, a hanging hook having one end attaching to the rod and an opposite end hanging on the shower curtain rod, an upper inside wall snap-on clip mounted a distance inwardly from the vertical plane of the shower curtain rod, a lower inside wall snap-on clip mounted a distance inwardly from the vertical plane of the shower curtain rod, wherein the rod and the hanging hook allows the shower curtain or shower curtain liner to be lifted from the shower curtain rod, moved inwardly the distance and snapped into the upper and lower inside wall snap-on clips to complete the water splash-out seal.

* * * * *